US008585356B2

(12) United States Patent
Wiebe et al.

(10) Patent No.: US 8,585,356 B2
(45) Date of Patent: Nov. 19, 2013

(54) CONTROL OF BLADE TIP-TO-SHROUD LEAKAGE IN A TURBINE ENGINE BY DIRECTED PLASMA FLOW

(75) Inventors: David J. Wiebe, Orlando, FL (US); Matthew D. Montgomery, Jupiter, FL (US)

(73) Assignee: Siemens Energy, Inc., Orlando, FL (US)

( * ) Notice: Subject to any disclaimer, the term of this patent is extended or adjusted under 35 U.S.C. 154(b) by 911 days.

(21) Appl. No.: 12/729,380

(22) Filed: Mar. 23, 2010

(65) Prior Publication Data

US 2011/0236182 A1 Sep. 29, 2011

(51) Int. Cl.
*F01D 11/20* (2006.01)

(52) U.S. Cl.
USPC ..... 415/173.2

(58) Field of Classification Search
None
See application file for complete search history.

(56) References Cited

U.S. PATENT DOCUMENTS

| | | | |
|---|---|---|---|
| 5,669,583 | A | 9/1997 | Roth |
| 6,027,306 | A | 2/2000 | Bunker |
| 6,419,446 | B1 | 7/2002 | Kvasnak et al. |
| 6,676,802 | B2 | 1/2004 | Roth |
| 6,976,824 | B2 | 12/2005 | Nottin |
| 7,134,842 | B2 | 11/2006 | Tam et al. |
| 7,183,515 | B2 | 2/2007 | Miller et al. |
| 7,255,062 | B1 | 8/2007 | Higman |
| 7,304,396 | B2 | 12/2007 | Haje et al. |
| 7,351,035 | B2 | 4/2008 | Deschamps et al. |
| 7,380,756 | B1 | 6/2008 | Enloe et al. |
| 7,410,532 | B2 | 8/2008 | Krichtafovitch et al. |
| 7,494,319 | B1 | 2/2009 | Liang |
| 7,588,413 | B2 | 9/2009 | Lee et al. |
| 2006/0005545 | A1 | 1/2006 | Samimy et al. |
| 2007/0258810 | A1 | 11/2007 | Aotsuka et al. |
| 2008/0067283 | A1 | 3/2008 | Thomas |
| 2008/0089775 | A1 | 4/2008 | Lee et al. |
| 2008/0101913 | A1 | 5/2008 | Lee et al. |
| 2008/0128266 | A1 | 6/2008 | Lee et al. |
| 2008/0131265 | A1 | 6/2008 | Lee et al. |
| 2008/0145210 | A1 | 6/2008 | Lee et al. |
| 2008/0145233 | A1 | 6/2008 | Lee et al. |

(Continued)

FOREIGN PATENT DOCUMENTS

WO WO 2005114013 A1 * 12/2005

OTHER PUBLICATIONS

J. Reece Roth, Xin Dai, Jozef Rahel, and Daniel M. Sherman; The Physics and Phenomenology of Paraelectric One Atmosphere Uniform Glow Discharge Plasma Actuators for Aerodynamic Flow Control; Presented at the American Institute of Aeronautics and Astronautics (AIAA) 43rd Aerospace Sciences Meeting and Exhibit, Reno Hilton Hotel, Reno, Nevada; Jan. 10-13, 2005, 37 pages.

(Continued)

*Primary Examiner* — Richard Edgar

(57) ABSTRACT

An electrode (54) in the tip (31) of a turbine or compressor blade (30), and a series of electrodes (68) in a shroud (36, 64) that surrounds a rotation path (33) of the blade tip. As the blade tip reaches each shroud electrode, a controller (74) activates an electrical potential between them that generates a plasma-induced gas flow (76) directed toward the pressure side (PS) of the airfoil. The plasma creates a seal between the blade tip and the shroud, and induces a gas flow that opposes a leakage gas flow (52) from the pressure side to the suction side (SS) of the blade over the blade tip (31).

12 Claims, 4 Drawing Sheets

(56) References Cited

U.S. PATENT DOCUMENTS

| | | | | |
|---|---|---|---|---|
| 2008/0149205 | A1 | 6/2008 | Gupta et al. | |
| 2009/0108759 | A1 | 4/2009 | Tao et al. | |
| 2009/0169356 | A1 | 7/2009 | Wadia et al. | |
| 2009/0169363 | A1 | 7/2009 | Wadia et al. | |
| 2009/0196765 | A1* | 8/2009 | Dyer et al. | 417/48 |
| 2010/0183424 | A1* | 7/2010 | Roy | 415/1 |

OTHER PUBLICATIONS

Julia Stephens, Thomas Corke, and Scott Morris; Turbine Blade Tip Leakage Flow control: Thick/Thin Blade Effects; Published in American Institute of Aeronautics and Astronautics (AIAA) paper 2007-0646; and Presented at 45th AIAA Aerospace Sciences Meeting and Exhibit; Denver, Colorado, Aug. 2-5, 2009, 17 pages.

Scott C. Morris, Thomas C. Corke, Daniel Vanness, Julia Stephens, and Travis Douville; Tip Clearance Control Using Plasma Actuators; Presented at the American Institute of Aeronautics and Astronautics (AIAA) 43rd Aerospace Sciences Meeting and Exhibit, Reno Hilton Hotel, Reno, Nevada; Jan. 10-13, 2005, 1 page (Abstract only).

Travis Douville, Julia Stephens, Thomas Corke, and Scott Morris; Turbine Blade Tip Leakage Flow Control by Partial Squealer Tip and Plasma Actuators; Presented at the American Institute of Aeronautics and Astronautics (AIAA) 44th Aerospace Sciences Meeting and Exhibit, Reno Hilton Hotel, Reno, Nevada; Jan. 9-12, 2006, 1 page (Abstract only).

* cited by examiner

CONTROL OF BLADE TIP-TO-SHROUD LEAKAGE IN A TURBINE ENGINE BY DIRECTED PLASMA FLOW

FIELD OF THE INVENTION

The invention relates to technology for reducing leakage of air or working gas through the clearance between a compressor or turbine blade tip and an adjacent shroud.

BACKGROUND OF THE INVENTION

Turbine engines have circular arrays of airfoils on rotating disks in both the compressor section and the turbine section of the engine. The airfoils are radially oriented with respect to the rotation axis, and are closely surrounded by a shroud that defines an outer envelope for the flow path of the working gas (air or combustion gases). The greater the clearance between the blade tips and shroud, the less efficient is the conversion of energy between the working gas and the rotating disk, since some of the working gas leaks over the airfoil tip. This clearance varies under differing operating conditions such as engine startup due to differential thermal expansion, thus making it hard to control the leakage. Much effort has been made to minimize this clearance, including reducing it so much that the blade tips occasionally touch and abrade the shroud. Some designs dynamically control the shroud diameter during engine operation.

Plasma generators have been used on aerodynamic components of turbine engines to influence boundary layers in various ways. For example US patent publication 2009/0169356 describes generating plasma in the tip-to-shroud clearance for aerodynamic stabilization. US patent publication 2008/0089775 describes reducing the effective tip-to-shroud clearance by filling it with plasma. A type of plasma generator often used in these efforts is called a dielectric barrier plasma generator, in which one electrode is covered with insulation and a second electrode is exposed to the intervening gas. This type of plasma generator is described for example in U.S. Pat. No. 7,380,756, which describes that airflow is induced by the plasma in a direction from the exposed electrode to the covered electrode when an alternating voltage is applied between the electrodes.

BRIEF DESCRIPTION OF THE DRAWINGS

The invention is explained in the following description in view of the drawings that show.

DETAILED DESCRIPTION OF THE INVENTION

Figure 1:
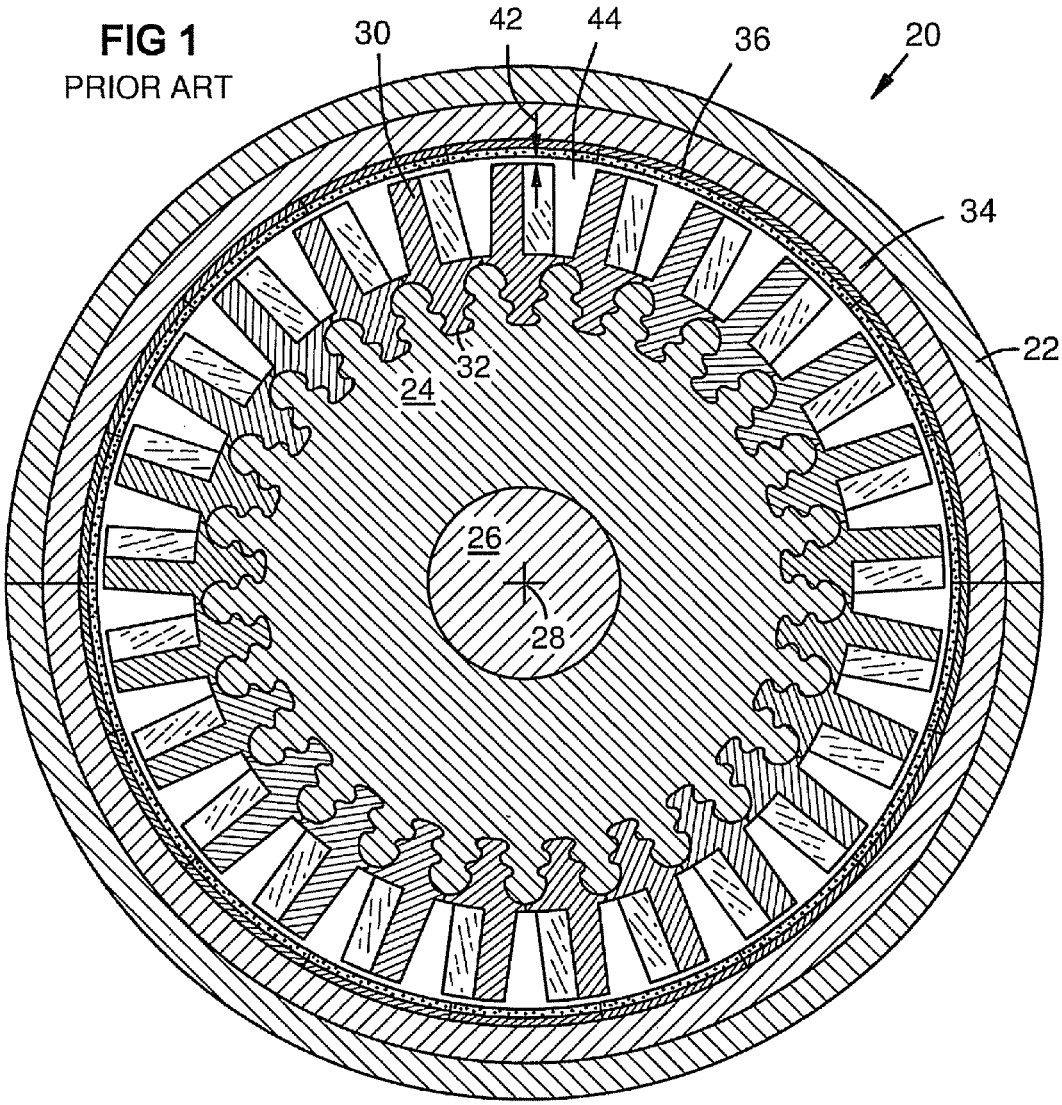
FIG 1 PRIOR ART
FIG. 1 is a conceptual sectional view of a prior art turbine or compressor disk.

FIG. 1 is a sectional view of a turbine or compressor disk 24 within a case 22 of a turbine engine 20. The disk is mounted on a shaft 26 with a rotation axis 28. Blades 30 are mounted in a circular array around the disk circumference via dovetail roots 32 or the blades may be formed integrally with the disk (not shown). A shroud 36 encircles the blades, and is supported by a shroud support structure 34. The blades have a clearance 42 between the blade tips and the shroud. A gas flow path 44 is defined between the disk 24 and the shroud 36 between the blades. FIG. 1 represents a type of known art.

Figure 2:
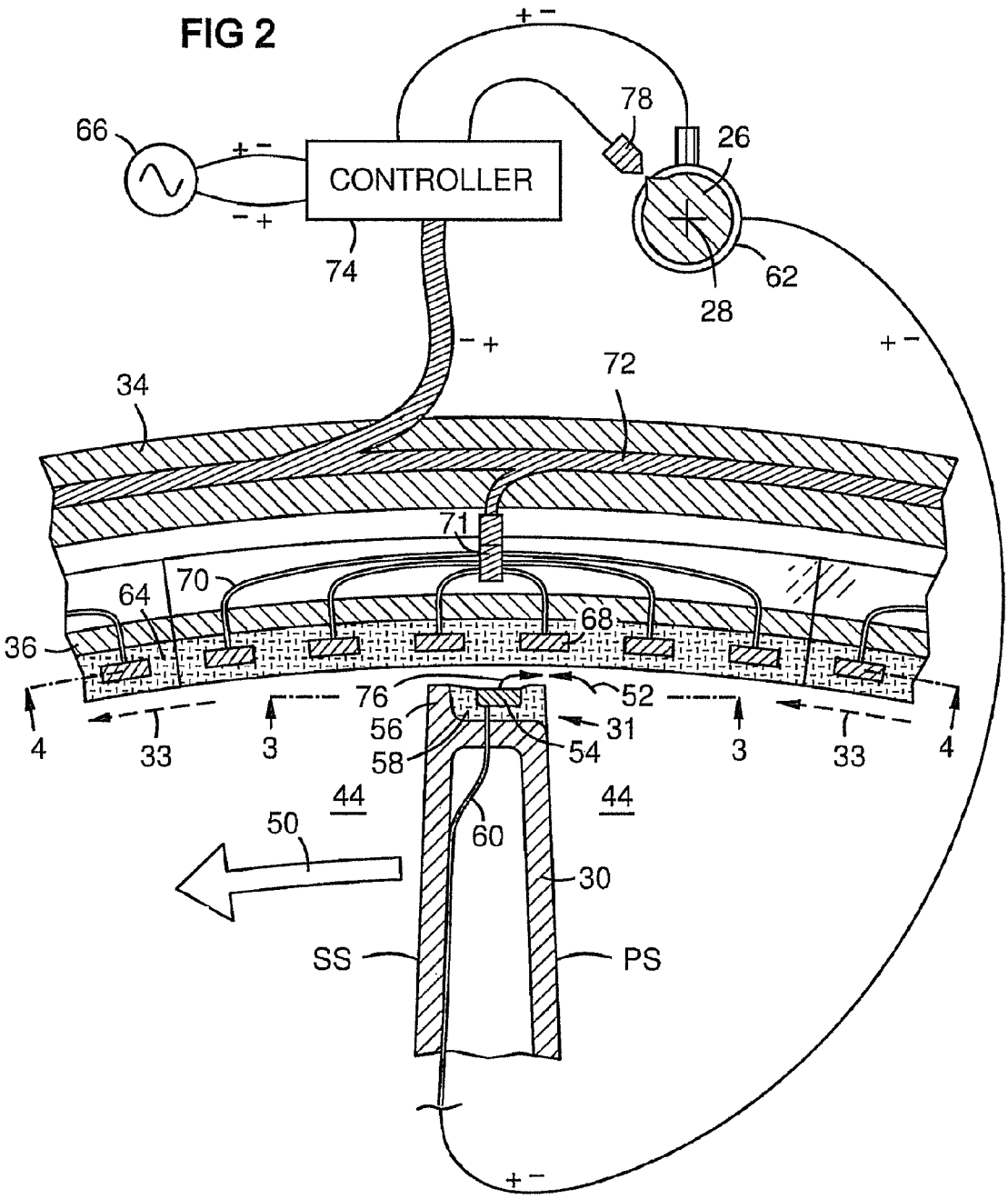
FIG. 2 is a sectional view of a rotating turbine airfoil and an adjacent shroud segment, with schematic control elements.

FIG. 2 is a schematic sectional view of a turbine blade 30 with a pressure side PS, a suction side SS, a tip 31, and a tip rotation path 33. A working gas flows through the gas flow path 44, and acts on the blade 30 to cause rotation 50 toward the suction side SS. The working gas leaks 52 over the blade tip 31 from the pressure side PS to the suction side SS, causing a loss of aerodynamic efficiency. An electrode 54 is mounted in the blade tip 31, and may be electrically insulated 58 from the blade material. It may be protected by a tip ridge 56 all around or partially around the blade tip. The electrode 54 may be supplied with an electrical potential via a conductor 60 that passes through the blade and within or along the shaft 26 to a slip ring 62 on the shaft, or to another device that provides the electrical potential. A power source such as a generator 66 may supply the potential to the slip ring 62 or other device.

Figure 4:
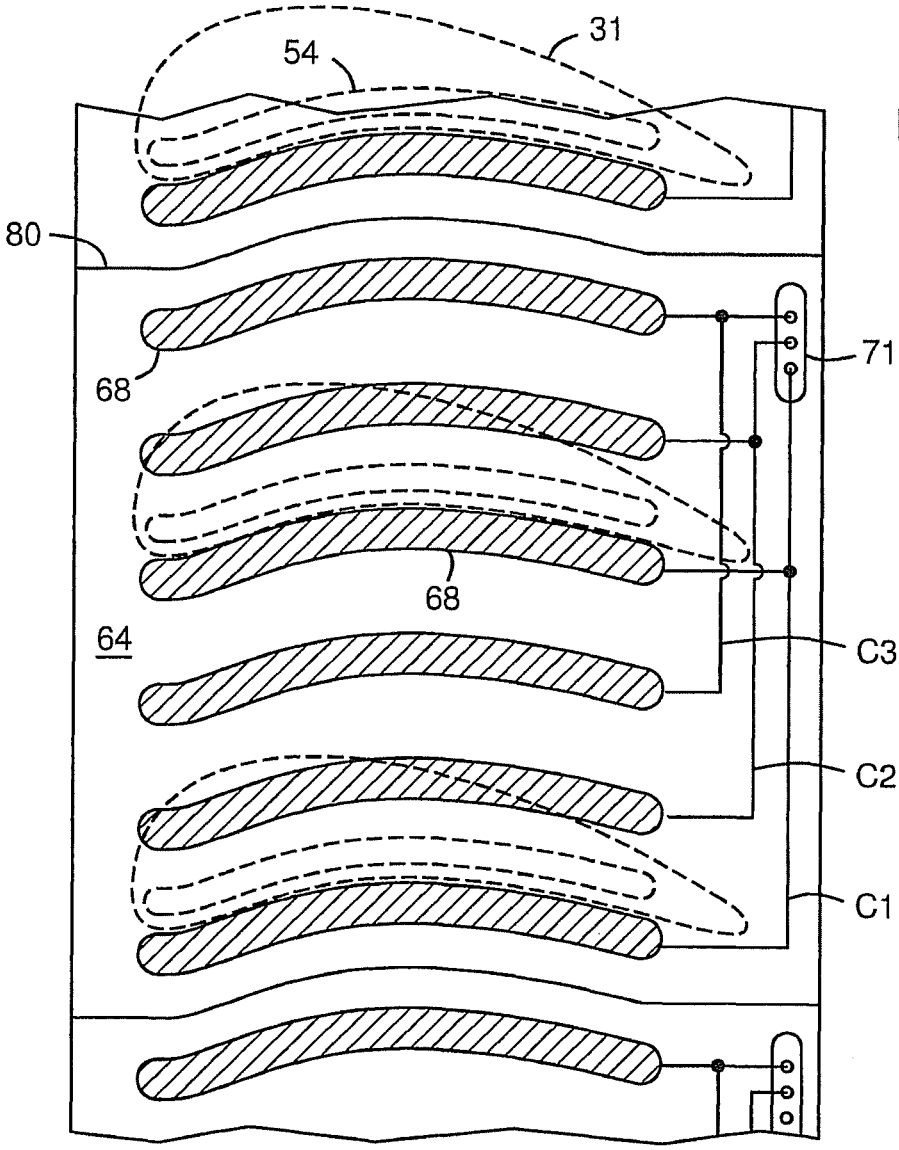
FIG. 4 is a sectional view of a shroud segment taken along line 4-4 of FIG. 2 showing the shroud electrodes with schematic circuit elements.

Shroud electrodes 68 are mounted in the shroud 36 facing the blade tip 31 and surrounding the path 33 of the blade tip. These electrodes 68 may be covered by an electrically insulating material 64, which may also serve as a thermal barrier for the shroud. Ceramic thermal barrier coatings are known, and some of them are electrically insulating, such as $AL_2O_3$. Each of the shroud electrodes 68 may be supplied with electricity via a conductor 70, which may be connected via a power bus 72 to a controller 74. The number of individually controllable power circuits CN depends on the ratio of blade electrodes B to shroud electrodes SE. CN=SE/B. If there is only one shroud electrode per blade electrode, and the shroud electrodes register in unison with the blade electrodes, then only one power circuit is needed, and all shroud electrodes are in a given shroud ring are controlled in unison. FIG. 4 shows an example of three shroud electrodes per blade electrode, with three individually controllable power circuits C1, C2, and C3.

The electrodes 54, 68 and conductors 60, 70 may be made of a high-temperature electrical conductor material such as iridium, platinum, yttrium, carbon fiber, graphite, tungsten, tungsten carbide, or others deposited by techniques known in the art. The conductors 70 in the shroud may be formed as power-conducting traces within the dielectric 64, similarly to conductors in printed circuit boards. The traces may lead to a connector 71 at some point on each shroud segment for connection to the power bus 72.

In the illustrated embodiment the blade tip electrode 54 is not covered by insulation, but is exposed to the clearance 42. As the blade tip 31 reaches each shroud electrode 68, the shroud electrode 68 and/or the blade tip electrode 54 is/are energized, producing a directed plasma 76 between the blade tip electrode 54 and the shroud electrode 68. This plasma induces a flow of ionized and neutral gas from the exposed electrode 54 to the covered electrode 68 as known in the art of dielectric barrier plasma generators. Such generators are described in U.S. Pat. No. 7,380,756, which is incorporated herein by reference, and are thus not further detailed here except as to enhancements.

The electrical potential delivered by the controller 74 may be in the form of alternating current (AC), also called a radio frequency (RF) voltage, as described in the incorporated U.S. Pat. No. 7,380,756 and others in the art. For example, if a turbine disk with 40 blades rotates at 3600 revolutions per minute (rpm), then 2400 activations or pulses of AC per second may be delivered by the controller 74 to each shroud electrode. If there are 40 shroud electrodes, then 2400 corresponding pulses of opposite phase may be delivered to each blade tip electrode 54. Alternately, either the shroud electrodes or the blade tip electrodes may provide a constant ground. Alternately the potential may be provided in pulses of DC current.

The number of shroud electrodes need not equal the number of blade electrodes. A formula for the activation frequency of a given shroud electrode in activations per second is B*RS/60, where B is the number of blades and RS is the disk rotation speed in rpm. For example, with 40 blades, a blade electrode in each blade tip, 80 shroud electrodes, and a rotation frequency of 3600 rpm, this calculation is 40*3600/60=2400 activations per second for each shroud electrode, regardless of the number of shroud electrodes. A formula for the activation frequency of a given blade electrode in activations per second is SE*RS/60, where SE is the number of shroud electrodes. In the above example this gives 80*3600/60=4800 activations per second for each blade electrode.

Figure 5:
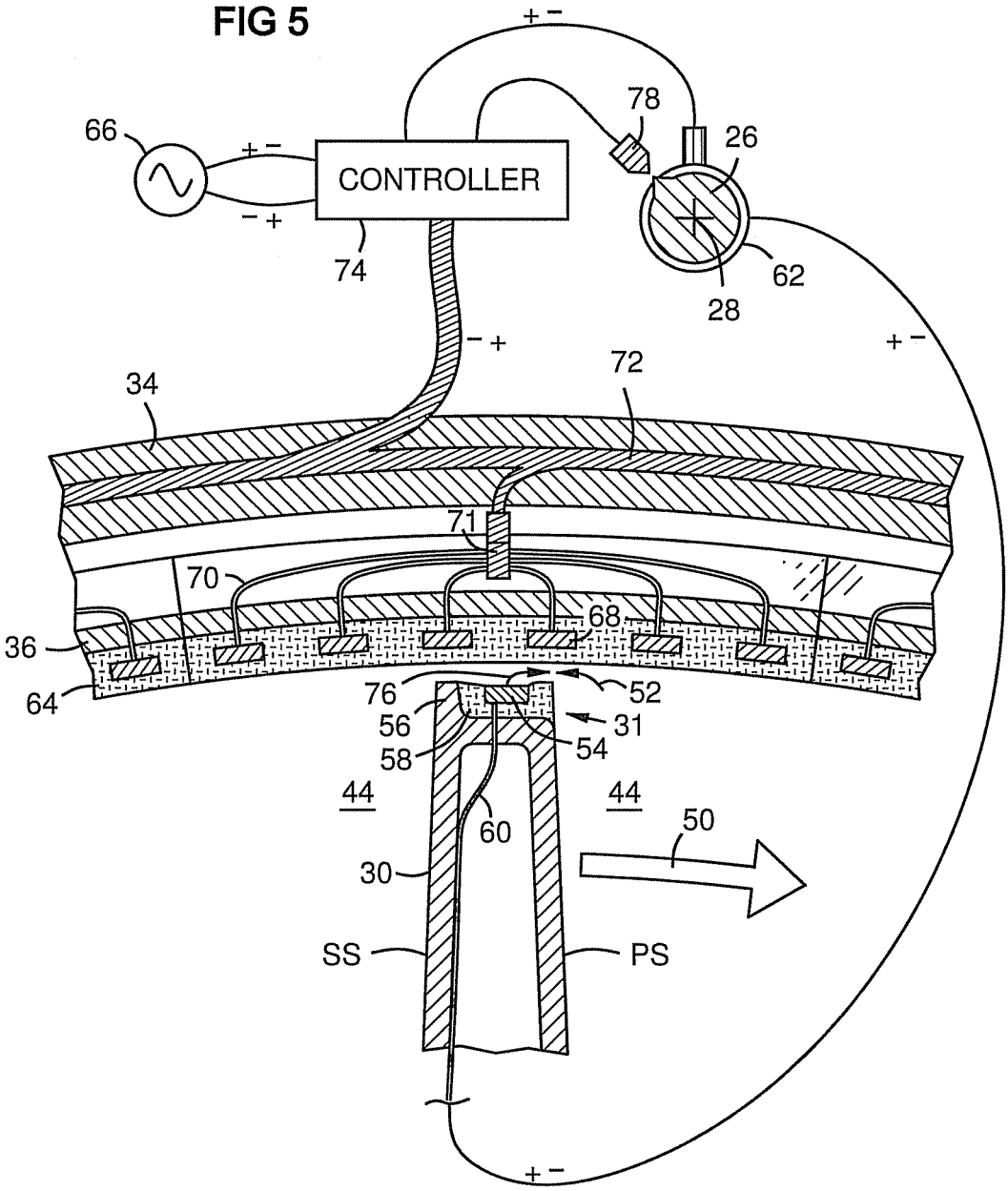
FIG. 5 is sectional view of a rotating compressor airfoil and an adjacent shroud segment, with schematic control elements.

In the turbine section, activation may occur at a given rotational position where each blade electrode 54 reaches an offset position past a given shroud electrode 68 as shown in FIG. 2. In the compressor, activation may occur at a given rotational position where each blade electrode 54 reaches an offset position prior to reaching registration with a given shroud electrode 68 as shown in FIG. 5. "Offset position" means not perfectly registered, and includes a range of positions from overlapping to spaced-apart from and within range of plasma generation.

In previous flow control applications, both electrodes are mounted on the same surface. This is seen for example in U.S. patent publication 2008/0089775, in which both electrodes are mounted on the shroud. In the present embodiment of FIG. 2 the exposed electrode is mounted in the blade tip, while the covered electrode is mounted in the shroud. This has two unexpected advantages: 1) the plasma creates a fence across the clearance 42, forming a zero-clearance seal that blocks the leakage 52, and 2) The backward-directed induced flow 76 produces a forward thrust on the blade tip, which does not occur if both electrodes are in the shroud. This not only blocks leakage better than the prior art, but contributes power to the turbine rotation. In a compressor, the plasma produces thrust against the blade rotation and a corresponding thrust against the air being compressed, thus scooping the air from the clearance for improved compression.

In order to time the electrical activations, the rotational position of the blades 30 may be provided to the controller 74 via a shaft timing sensor 78. Such timing devices are well-known, and may include a magnetic timing mark on the shaft 26 that is detected by a stationary coil or Hall-effect sensor 78 adjacent to the shaft. The controller may energize the electrical potential to each shroud electrode 68 in succession as the blade tip passes. It may also activate a corresponding opposite potential to the blade tip electrode. Alternately, either the blade electrode or the shroud electrodes may be grounded. Optionally the whole rotating frame may be grounded, which includes the shaft 26 and the attached disk 24 and blades 30. Such grounding allows the blade tips themselves to serve as ground electrodes.

Figure 3:
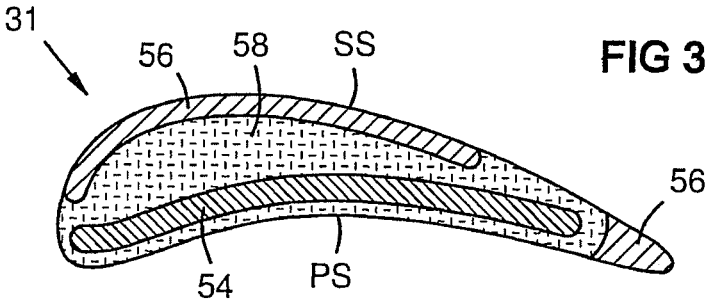
FIG. 3 is a sectional view through a blade tip, taken along line 3-3 of FIG. 2.

FIG. 3 is a sectional view through the blade tip 31 looking radially outward toward the shroud 36 along line 3-3 of FIG. 2. This illustrates an exemplary geometry of the tip electrode 54, insulation 58, and protective ridges 56. The tip electrode 54 may follow a curvature of the blade tip as shown.

FIG. 4 shows a sectional view of a shroud segment of FIG. 2 taken along line 4-4 of FIG. 2, showing the shroud electrodes and schematic circuit elements C1, C2, and C3, and also shows the insulated surface 64 of the shroud beyond the blade tip 31. The shroud electrodes 68 may follow the curvature of the tip electrodes, increasing effectiveness and efficiency over straight electrodes. The shroud may be segmented as known in the art. The segmentation joint lines 80 may follow the curvature of the shroud electrodes 68.

FIG. 5 shows the system applied to a compressor, in which the blade rotates 50 toward the pressure side PS. In this embodiment, the controller may activate the electrical potential as the blade tip electrode 54 approaches each shroud electrode 68. In the turbine embodiment of FIG. 2 the controller may activate the electrical potential as the blade tip electrode 54 passes over each shroud electrode 68. In both cases, the plasma-induced gas flow 76 is directed toward the pressure side PS of the airfoil.

Herein dielectric-covered electrodes 68 are shown in the shroud, and an exposed electrode 54 is shown in the blade tip. This can be reversed, with the exposed electrode 68 being in the shroud, and the covered electrode 54 in the blade tip. The timing of electrical activation depends on the direction of the plasma-induced gas flow between the electrodes, which in some embodiments is from the exposed electrode to the covered electrode per U.S. Pat. No. 7,380,756. When direct current is used, the induced gas flow follows the mobility drift of positive ions from positive to negative. In any case, activation occurs when the blade electrodes and respective shroud electrodes are adjacent and offset to produce a plasma-induced flow toward the pressure side of the airfoil. In one embodiment, the plasma may be generated by AC, and accelerated by a DC bias voltage between the shroud and blade electrode before and/or after the blade passes.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An aerodynamic clearance control system comprising:
an airfoil on a rotatable shaft, the airfoil comprising a tip;
an electrode disposed at the airfoil tip;
a shroud surrounding a rotation path of the airfoil tip;
an electrode disposed at the shroud; and
a controller that activates an electrical potential between the blade electrode and the shroud electrode when the blade electrode and shroud electrode are adjacent and offset;
wherein the electrical potential is effective to produce a plasma-induced flow of a gas toward a pressure side of the airfoil; and
wherein the tip electrode follows a curvature of the blade tip, and the shroud electrode follows a curvature of the tip electrode.

2. An aerodynamic clearance control system comprising:
a circular array of airfoils on a rotatable shaft, each airfoil comprising a pressure side, a suction side, and a tip;
a shroud surrounding a rotation path of the airfoil tips, the shroud separated from the rotation path of the airfoil tips by a clearance;
an electrode in the tip of each airfoil;
a series of electrodes in the shroud; and
a controller that activates an electrical potential between each airfoil tip electrode and each of the shroud electrodes in succession effective to generate a plasma-induced gas flow in the clearance that is directed toward the pressure side of the airfoil;

wherein the tip electrodes and the shroud electrodes each follow a curvature of the blade tips.

3. The aerodynamic clearance control system of claim 2, further comprising a sensor that inputs a rotational position of the airfoils to the controller, wherein the controller activates the electrical potential between each airfoil tip electrode and an adjacent shroud electrode at each rotational position of the airfoils where each airfoil tip reaches a given position relative to the adjacent shroud electrode.

4. The aerodynamic clearance control system of claim 3, wherein the shroud electrodes are covered by a dielectric material, and the airfoil tip electrodes are exposed to the clearance.

5. The aerodynamic clearance control system of claim 4, wherein the dielectric material comprises a thermal barrier coating.

6. The aerodynamic clearance control system of claim 3, wherein the airfoils are turbine airfoils, and the given position is where each airfoil electrode reaches an offset position past the adjacent shroud electrode.

7. The aerodynamic clearance control system of claim 3, wherein the airfoils are compressor airfoils, and the given position is where each airfoil electrode reaches an offset position before it reaches the adjacent shroud electrode.

8. The aerodynamic clearance control system of claim 3, wherein each shroud electrode is activated by the controller at a frequency in activations per second of B*RS/60, where B is a number of blades in the circular array and RS is a disk rotation speed in rpm.

9. The aerodynamic clearance control system of claim 3, wherein each airfoil electrode is activated by the controller at a frequency in activations per second of SE*RS/60, where SE is a number of electrodes in the shroud and RS is a disk rotation speed in rpm.

10. The aerodynamic clearance control system of claim 3, wherein the controller activates the shroud electrodes in individually controllable sets, each set containing B number of shroud electrodes, where B is a number of blades in the circular array.

11. The aerodynamic clearance control system of claim 2, wherein the shroud electrodes are electrically insulated from the shroud and the airfoil tip electrodes are electrically insulated from the airfoils.

12. An aerodynamic clearance control system comprising:

a circular array comprising a given number B of turbine or compressor airfoils, each airfoil comprising a pressure side, a suction side, a tip, and a rotation axis;

a shroud surrounding a rotation path of the airfoil tips;

a plasma generation system comprising an electrode on the tip of each airfoil and a series of electrodes in the shroud; and a controller that activates voltages in the shroud electrodes in one or more individually controllable sets, each set containing B number of shroud electrodes;

wherein the voltages produce electrical potentials between the airfoil electrodes and respective adjacent ones of the shroud electrodes as the airfoil electrodes reach a given position relative to the respective adjacent shroud electrodes during a rotation of the circular array; and wherein the electrical potential generates a plasma-induced gas flow directed toward the pressure side of the airfoil in a clearance between the airfoil tip and the shroud; and wherein the tip electrodes and the shroud electrodes each follow a curvature of the blade tips.

* * * * *